United States Patent [19]

Blitshteyn et al.

[11] Patent Number: 4,665,462

[45] Date of Patent: May 12, 1987

[54] IONIZING GAS GUN FOR BALANCED STATIC ELIMINATION

[75] Inventors: Mark Blitshteyn, Edison, N.J.; Richard D. Rodrigo, Lansdale; William S. Wright, Green Lane, both of Pa.

[73] Assignee: The Simco Company, Inc., Hatfield, Pa.

[21] Appl. No.: 745,701

[22] Filed: Jun. 17, 1985

[51] Int. Cl.[4] ..... H05F 3/00

[52] U.S. Cl. ..... 361/213; 361/235

[58] Field of Search ..... 361/213, 227, 229, 230, 361/235, 228; 323/903; 250/324, 325; 55/105, 106, 139; 239/692, 706, 708

[56] References Cited

U.S. PATENT DOCUMENTS

| | | | |
|---|---|---|---|
| 3,156,847 | 11/1964 | Schweriner | 361/230 |
| 3,714,531 | 1/1973 | Takahashi | 361/230 |
| 4,027,686 | 6/1977 | Shortes et al. | 134/33 |
| 4,132,567 | 1/1979 | Blackwood | 134/18 X |
| 4,318,152 | 3/1982 | Weber | 361/235 X |
| 4,333,123 | 6/1982 | Moulden | 361/213 |
| 4,423,462 | 12/1983 | Antonevich | 361/230 X |
| 4,477,263 | 10/1984 | Shaver | 361/235 |
| 4,523,463 | 6/1985 | Fathauer et al. | 55/105 X |
| 4,533,368 | 8/1985 | Snaddon et al. | 55/105 X |

*Primary Examiner*—L. T. Hix
*Assistant Examiner*—D. Rutledge
*Attorney, Agent, or Firm*—Stanley Bilker

[57] ABSTRACT

Ionizing gas gun for ultra-clean static neutralization comprises a plastic nozzle enclosing positive and negative ion discharge electrodes and means for blowing a gas, such as air or nitrogen therethrough. A trigger actuates both the release of gas and application of positive and negative high voltage to the respective discharge electrodes, including delay circuitry for suspending discontinuance of the positive high voltage to its electrode for a momentary period subsequent to discontinuance of the negative high voltage when the gas is cut off in compensation of a slight preponderance of negative ion emission otherwise effected at cut-off. Venturi ports at the nozzle tip draw air over the discharge electrodes for admixing with higher mobility nitrogen ions when nitrogen rather than air is employed as the blowing medium. A changeable filter insures cleanliness, including monitoring means to indicate clogged or ruptured filter conditions or improper installation.

20 Claims, 7 Drawing Figures

FIG. 1
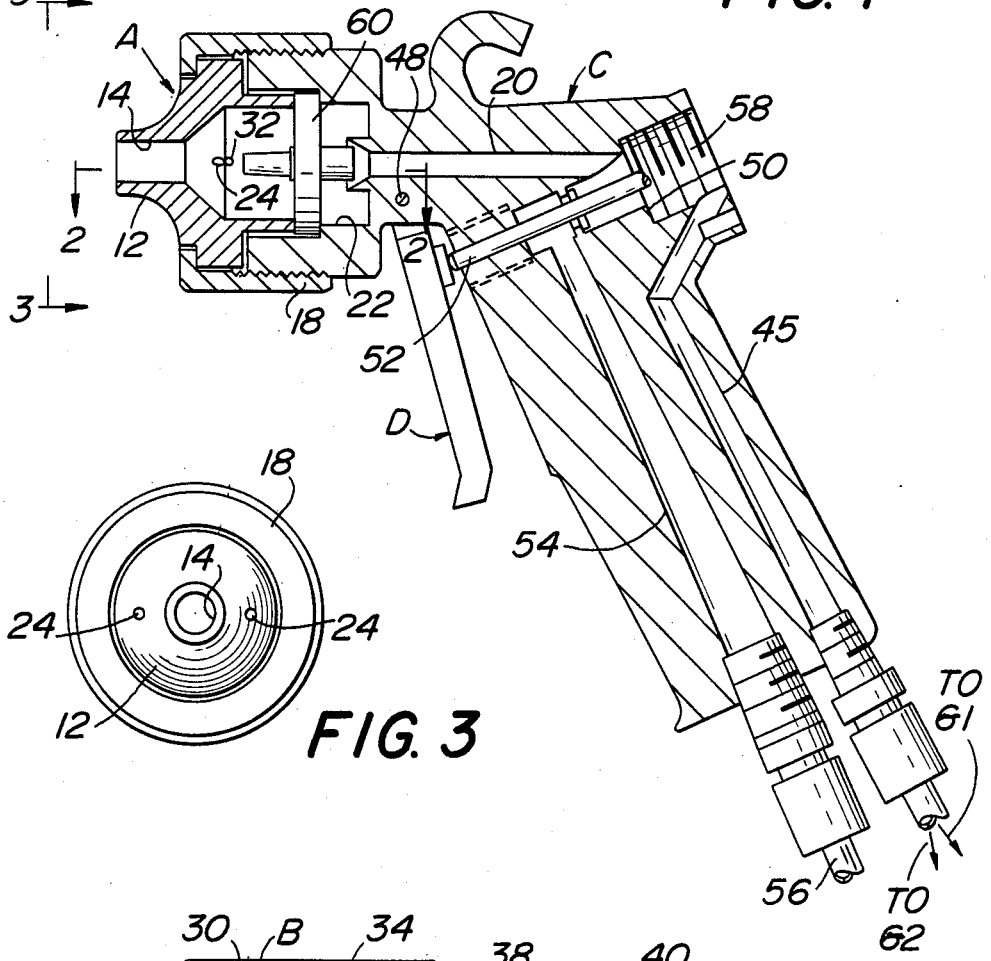
FIG. 3
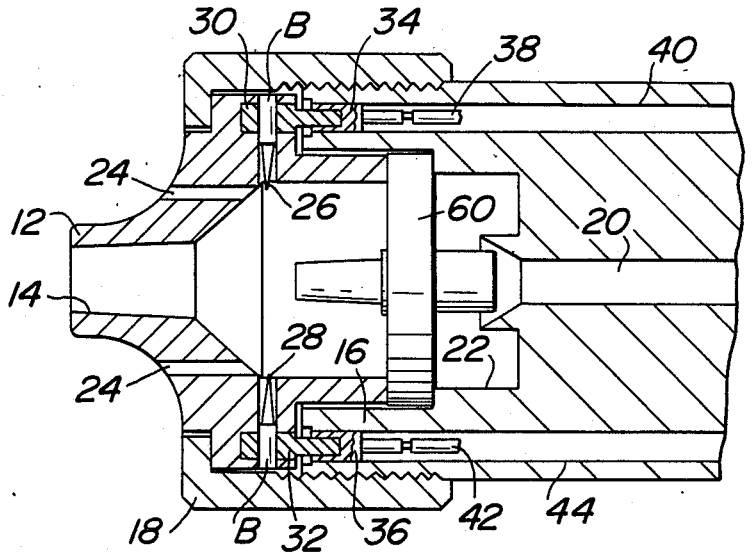
FIG. 2

FIG. 5
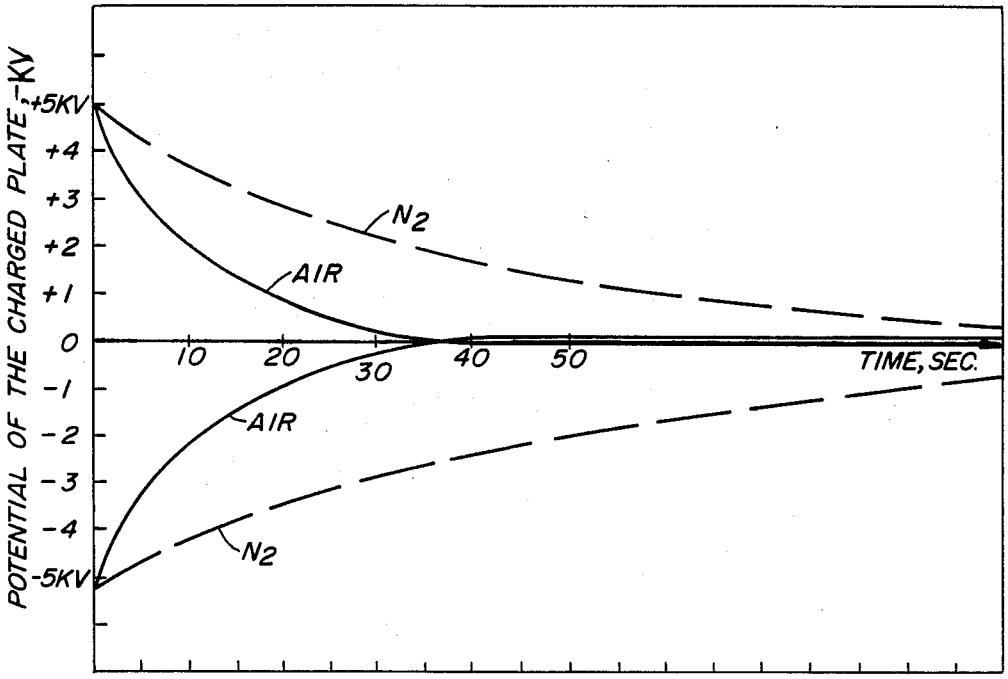
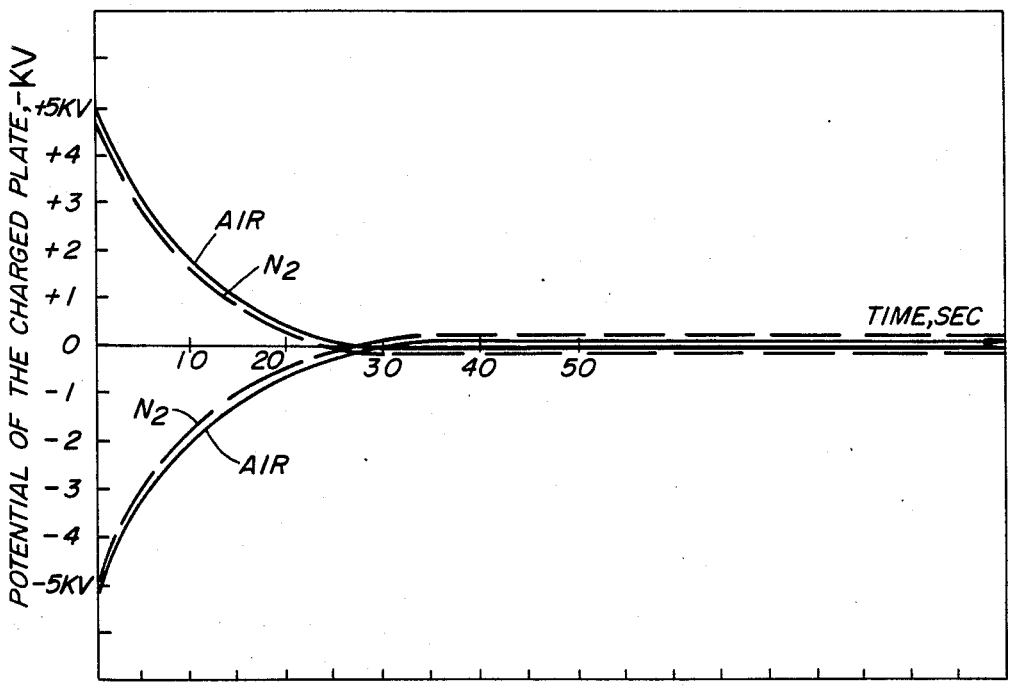
FIG. 6

IONIZING GAS GUN FOR BALANCED STATIC ELIMINATION

BACKGROUND OF THE INVENTION a. Field of the Invention

This invention relates to ionizing gas guns or nozzles in which a stream of air or other gas is blown over corona discharge electrodes internally enclosed within the nozzle to forcibly direct positive and negative ions emitted thereby against targeted articles or objects in order to effect static neutralization thereof. More particularly, this invention pertains to ionizing air guns or nozzles intended for use in ultra-clean environments wherein an inert gas, such as nitrogen, can be employed as the medium for spraying the dual polarity ions against the surface of the articles. The novel concepts of the present invention are intimately related to assuring that the dual polarity ion emission is always balanced in the production of positive and negative ions.

b. Prior Art

U.S. Pat. No. 3,156,847 and No. 3,179,849 show examples of ionizing air guns or nozzles in which air is blown over a discharge electrode coupled to an A.C. high voltage power source wherein a stream of dual polarity ions is forcibly directed against charged articles in order to statically neutralize such articles and any particles on the surface thereof.

In U.S. Pat. No. 4,423,462, No. 4,093,543, No. 3,714,531 and No. 2,879,395 are shown various systems for controlling or equalizing the ratio of positive and negative ion emission, which is ordinarily unbalanced because of the geometry of the particular static bar construction, including whether the discharge points were directly or capacitively coupled to the A.C. high voltage generator.

For ultra-clean room applications, where submicroscopic dust and microparticulate contaimination is of major consideration in the manufacture and/or assembly of components, such as semiconductor substrates, compressed nitrogen has often been used as the blowing medium because of its inert character and greater facility to ionize under the high voltage field at the discharge points. For the use of nitrogen as the blowing gas in ionizing gas guns and nozzles, see U.S. Pat. No. 4,027,686 and No. 4,132,567.

Also of considerable significance for efficient operation within ultra-clean rooms is the need to provide chemical inertness of the gun material as well as the desirability to reduce the weight and cost of the gun per se. Thus, it would appear appropriate to utilize plastics for the gun body and avoid the use of metal as much as possible. However, because of the non-conductive nature of plastic materials generally, there is no convenient way to provide a proximity ground for producing, as in a conventional A.C. static neutralizer, a high intensity field between the discharge points and ground. It therefore becomes necessary to utilize a double D.C. approach wherein positive and negative discharge electrodes are respectively coupled to corresponding positive and negative high voltage power supplies (i.e., the field being produced between the electrodes of opposite polarity rather than between each electrode and ground). Pat. No. 4,333,123 discloses an ionizing air gun having an all non-conductive housing enclosing first and second discharge tips which are connected to respective D.C. high voltage sources along with extended barriers to inhibit ion recombination thus extending the neutralizing range.

PURPOSE

When high voltage is applied to the discharge electrodes of static eliminators, the high intensity field produces corona discharge at the tips of the electrodes and ionization of the gas therebetween. The flow of bipolar ions in an ionizing gas gun exits the nozzle at relatively high velocity so that the stream of ions may be targeted against articles toward which the gun is directed with the objective to neutralize the static charges and blow the neutralized particles away. In a conventional static neutralizer, where the A.C. high voltage is coupled to the discharge electrodes with respect to ground, the positive and negative high voltages to the discharge points are balanced initially in order that the stream emitted from the nozzle contains an equal number of ions of each polarity, and it is normally unnecessary to readjust balancing controls once set.

However, in an ionizing gas gun using a double D.C. arrangement (i.e. coupling a first discharge electrode to a D.C. source of one polarity and a second discharge electrode to a D.C. source of the other polarity, it has been found that discontinuance of the D.C. high voltage to both discharge electrodes simultaneously when the gas flow is cut off causes a slight excess of negative ions to be produced in the exiting stream even though the dual polarity high voltage to the discharge electrodes has already been appropriately balanced. At the end of treatment, this leads to slight charging of the objects being targeted instead of the desired neutralization. It has also been observed that a slight excess of positive ions is present in the initial gas stream of an already balanced double D.C. ionizing gas gun when the positive and negative high voltages are applied simultaneously to both discharge electrodes concurrently with the inception of gas flow. One theory is that the "over-neutralization" phenomenon is caused by the greater mobility of negative ions vis-a-vis positive ions generally.

In the case where nitrogen is employed as the gas being forced between the ionizing electrodes, there is a tendency for a higher ionizing current to be created between the electrodes because nitrogen is more readily ionizable than air. In addition, because nitrogen ions are more mobile than air ions, most of the nitrogen ions generated in the interelectrode gap move toward the opposite electrode rather than out through the nozzle. As a consequence of the greater ionization capability of nitrogen and the higher mobility of its ions, larger output currents are produced in the high voltage supplies at comparable voltages, thereby leading to likelihood of power supply overload. It is readily seen that the combined effect of the foregoing factors is to reduce materially the number of ions available for distribution in the exiting stream for impingement upon charged objects.

It is therefore an object of this invention to provide an ionizing gas gun for ultra-clean static neutralization whereby the ion output remains constant and balanced when nitrogen rather than air is utilized as the compressed gas source.

Another object of this invention is to provide an ionizing gas gun embodying first and second discharge electrodes coupled to respective D.C. high voltage power supplies of opposite polarity in which delay circuitry is incorporated to compensate for the difference in mobility of positive and negative ions.

Still another object of this invention is to provide an ionizing gas gun with a low weight body made of chemically inert material.

Yet still another object of this invention is to provide an ionizing gas gun for use with nitrogen wherein excessive ionizing currents as are likely to overload high voltage power supplies are avoided.

A further object of this invention is to provide an ionizing gas gun in which a replaceable cartridge filter is employed and wherein signal means is included to indicate when the filter becomes either clogged or ruptured or if such filter is improperly installed or inadvertently omitted Yet a further object of this invention is to provide an ionizing gas gun employing corresponding positive and negative high voltage generators and in which signal means are included to indicate when the high voltage outputs (i.e. positive and negative ion flow) become unbalanced or fall below predetermined levels.

Still a further object of this invention is to provide an ionizing gas gun for ultra-clean static neutralization wherein all components may be quickly disconnected for servicing the gun or replacement of the filter or for assembly with a variety of nozzles having diverse gas flow characteristics.

SUMMARY OF THE INVENTION

In accordance with this invention, there is provided an ionizing gas gun for use with compressed air or an inert gas, such as nitrogen, for ultra-clean static neutralization of charged articles. The gun includes a plastic nozzle entirely enclosing a set of positive and negative discharge electrodes—i.e. a dual D.C. arrangement in which a D.C. positive high voltage power source is connected to one electrode while a D.C. negative high voltage power source is coupled to the other electrode. The discharge electrodes are adjacently spaced from each other in axially aligned disposition transverse to the direction of gas flow through the nozzle. A trigger actuates the release of the compressed gas through the nozzle and the application of corresponding D.C. high voltages to the respective discharge electrodes.

Where a gas other than air is employed as the medium blown through the inter-electrode gap, there is usually a different ion current generated between the discharge electrodes. Accordingly, even though a system has been balanced for air, it is generally necessary to compensate for the variation in the ionizing current produced by the gas ions of another gas medium wherein desired ion emission may be reestablished. When nitrogen is utilized as the compressed gas source, the greater ionization capability thereof as compared to air and because of the greater mobility of nitrogen ions versus air ions, a greater ion current and hence a larger output current is produced in the high voltage power supplies. This not only causes overload conditions in the power supplies themselves but also reduces the number of ions available for neutralization in the exiting gas stream.

One aspect of the present invention includes circumferentially disposed Venturi ports at the nozzle tip which enables air to be drawn into the gap between the discharge electrodes when compressed nitrogen instead of compressed air is employed as the blowing medium. The ambient air drawn through the Venturi ports and into the interelectrode gap admixes with and acts as a dilutant for the nitrogen passing therethrough so as to attenuate the greater ionizability thereof whereby greater portions of the neutralizing ions generated between the discharge electrodes are available for impingement upon the targeted articles.

In accordance with another aspect of the present invention, means constituting delay circuitry is incorporated in the D.C. high voltage output to the electrodes to compensate for the greater mobility of negative ions with respect to positive ions generally. It has been found that when the high voltage to both discharge electrodes is discontinued simultaneously with the stoppage of flow of the compressed gas stream, there will be a preponderance of negative ions in the emission from the nozzle even though the high voltage outputs have previously been balanced. By suspending or delaying the discontinuance of the D.C. positive high voltage to its discharge electrode for a brief predetermined period subsequent to discontinuance of the negative high voltage and cut-off of the gas stream, positive ion generation will be sustained to effect complete neutralization at the end of treatment rather than having a slight negative charge remain on articles when the gun is turned off.

Similarly, although to a much less important by delaying the imposition of the D.C. positive high voltage to its discharge electrode for a predetermined period after the trigger is actuated to institute gas flow and apply negative high voltage to its electrode, a slight excess positive ion emission in the starting stream may be avoided. Thus, by appropriately retarding inception or cut-off of the D.C. positive high voltage during start up or stoppage of ionizing gas gun treatment, transient "overneutralization" of objects being targeted will be eliminated .

A readily-changeable cartridge filter easily insertable within the nozzle promotes cleanliness by removal of microscopic particulates from the gas stream and precludes such particles from impinging upon the targeted articles. A flow sensor detects and indicates deviation from a preset nominal flow condition should the filter become clogged or ruptured or should there be improper or failure of installation thereof. Alarm signals are also provided to indicate when the high voltage outputs become unbalanced or fall below predetermined levels so as to assure that the gun is providing static neutralization.

BRIEF DESCRIPTION OF THE DRAWINGS

With the above and related objects in view, this invention consists of the details of construction and combination of parts as will be more fully understood from the following detailed description when read in conjunction with the accompanying drawings, in which:

FIG. 1 is a side elevational view, and partly in section, of an ionizing gas gun embodying this invention.

FIG. 2 is a sectional view taken generally along lines 2—2 of FIG. 1.

FIG. 3 is a partial front elevational view of the gas gun nozzle taken generally along lines 3—3 of FIG. 1.

FIG. 5 is a graphical representation of typical electrostatic decay curves of a charged object whose static neutralization treatment was administered by non-ported ionizing gas guns using (a) air and (b) nitrogen.

FIG. 6 is a graphical representation of typical electrostatic decay curves of a charged object whose static neutralization treatment was administered by the ported-nozzle, ionizing gas gun of the instant invention using (a) air and (b) nitrogen.

DETAILED DESCRIPTION

Figure 4A:
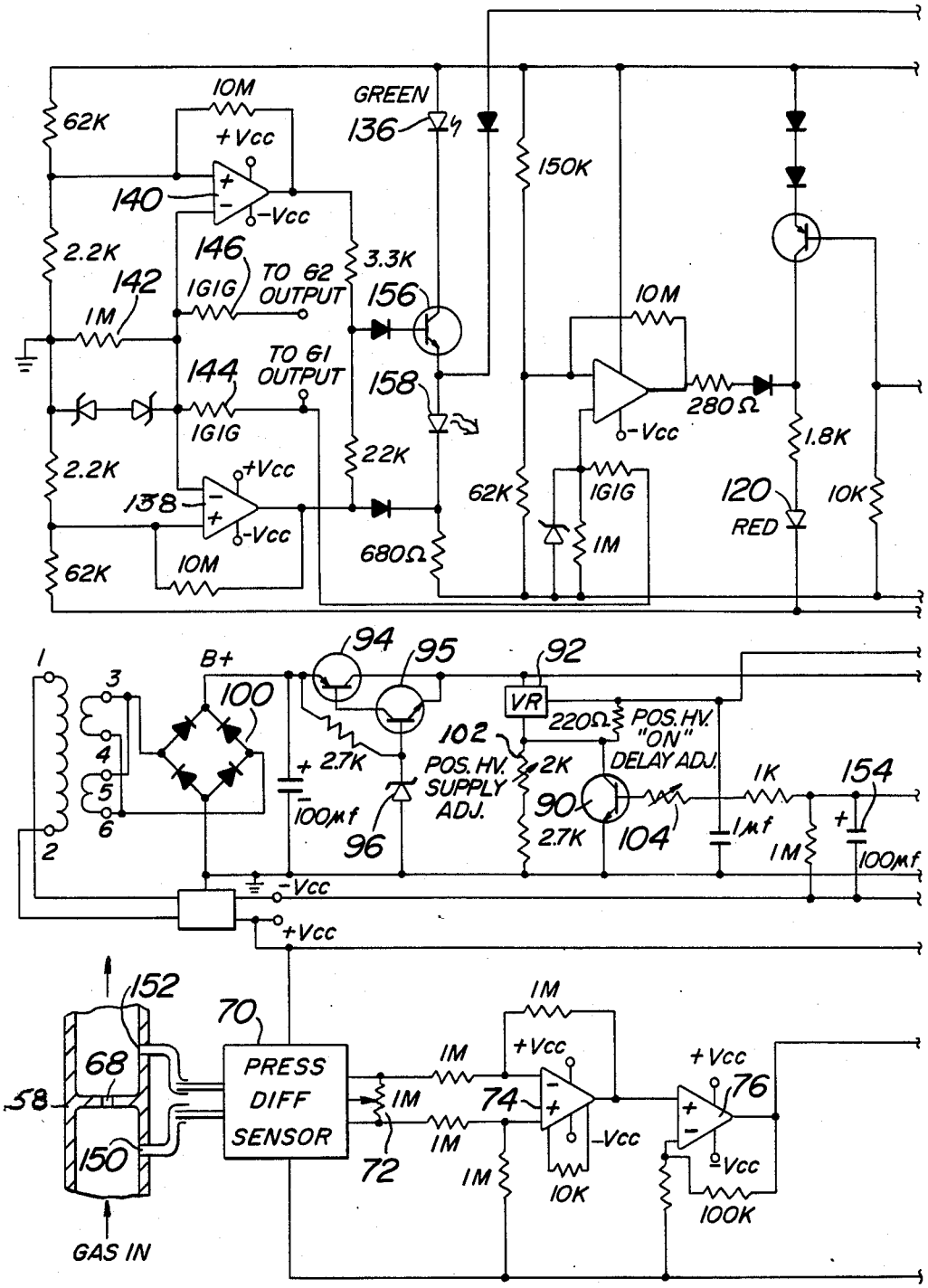
FIG. 4A and 4B is an electrical schematic diagram showing the operating and control circuitry embodying this invention.

Referring now in greater detail to the drawings in which similar reference characters refer to similar parts, there is shown an ionizing gas gun comprising a nozzle, generally designated as A, discharge electrodes B fully enclosed within the nozzle, a gun body C containing a conduit through which the discharge electrodes are respectively coupled to positive and negative high voltage power supplies G1 and G2 as well as a passageway for connecting the nozzle to a source of compressed gas, and a trigger D for actuating the ejection of gas through the nozzle. Control circuitry E functions to apply high voltage to the electrodes when the trigger D is depressed to initiate gas flow and to cut off the high voltage to the electrodes B when the trigger is released to stop the stream of gas, said circuitry including delay means for suspending the discontinuance of the D.C. positive high voltage output for a predetermined period subsequent to discontinuance of negative high voltage output and cut-off of gas flow whereby positive ion emission may be sustained sufficiently to provide entirely balanced neutralization of targeted objects. The circuitry E also includes delay means for retarding initiation of the D.C. positive high voltage output for a pretermined length of time after triggering the inception of gas flow and the institution of the negative high voltage output whereby the initial ionized gas stream will be balanced in positive and negative ion content.

The nozzle A includes a plastic tip 12 containing an internal orifice 14 which, when the tip is attached to the barrel end 16 of the gun body C by tightening nut 18, communicates with the bore 20 in the the body via chamber 22. The nozzle A, the gun body C and the nut 18 are molded of a suitable polymeric material, such as polytetrafluorethylene, whereby all metal or conductive parts are completely enclosed. A plurality of small peripherally-disposed passageways 24 in the nozzle tip 12 act as Venturi ports for drawing air into the interelectrode gap between the discharge points B to compensate for the greater ion mobility and higher ionization capability of gases, such as compressed nitrogen, when they are subjected to the action of the discharge points and expelled through the orifice 14. That is, the effect of the higher mobility of nitrogen ions is diluted by drawing air from outside the nozzle A through the ports 24 into the interelectrode ionization zone to reduce the otherwise higher ionizing current between the electrodes B which could overload the high voltage power supplies previously adjusted for air ionization. In addition, the admixing of the Venturi drawn-in air with the expressed nitrogen stream enables a greater portion of the neutralizing ions to be blown through the orifice 14 rather than recombining with the discharge electrodes of opposite polarity.

FIG. 5 shows typical decay curves of a positively charged and a negatively charged object subjected to an ionizing gas gun utilizing a conventional nozzle (without Venturi ports) (a) when just compressed air is directed through the ionization zone and (b) when compressed nitrogen is expressed through said zone. It is to be noted that both the positively charged and negatively charged plate decay curves are much slower when nitrogen is the compressed gas used than when compressed air is employed, even though control settings for flow rates and output preset for air ionization are identical. FIG. 6 demonstrates typical decay curves for a positively charged object and a negatively charged object exposed to the Venturi-ported ionizing gas gun of the instant invention (a) when air is the expressed gas and (b) when nitrogen is forced through the ionization zone. The decays are substantially identical indicating that the neutralization efficacy of the ionizing gas gun of the instant invention is the the same using nitrogen as it is with air without rebalancing or adjusting the level of the high voltage applied to the electrodes B.

The discharge electrodes B comprise at least one pair of conductive needles or points 26 and 28 which are mounted in the nozzle tip 12 in adjacently spaced axial disposition with each other and oriented transverse to the gas flow. The points 26 and 28 are retained within recesses in the tip 12 by means of mounts 30 and 32 pressed therein. The mounts 30 and 32 are adapted to be received within complementary female terminals 34 and 36 contained in the end of the gun when the molded nut 18 is threaded down upon the barrel 16. Female terminal 34 is connected to the output of the D.C. positive high voltage generator G1 by way of cable 38 in passageway 40 of the gun barrel and thence through conduit 45 in the grip portion of the body C. Female terminal 36 is connected to the output of the D.C. negative high voltage generator G2 by way of cable 42 in passageway 44 of the gun barrel and then through conduit 45 of the grip in conjunction with cable 38. The respective cables 38 and 42 may also be drawn through a single conduit (not shown) within the gun barrel.

The trigger D is adapted to actuate a conventional gas valve 50 in the gun body C which couples gas passageway 54 in the grip portion thereof with the central bore 20 leading to the nozzle chamber 22. The passageway 54 is interconnected by suitable tubing 56 to a source of pressurized gas. A suitable interchangeable cartridge filter 60 is installed between the gun bore 20 and the nozzle chamber when the tip 12 is attached to the barrel end. The filter is conventional and is adapted to remove all microparticulate material from the gas stream prior to impingement of the ionized gas emission upon charged articles or other objects when the trigger is D squeezed.

Figure 4B:
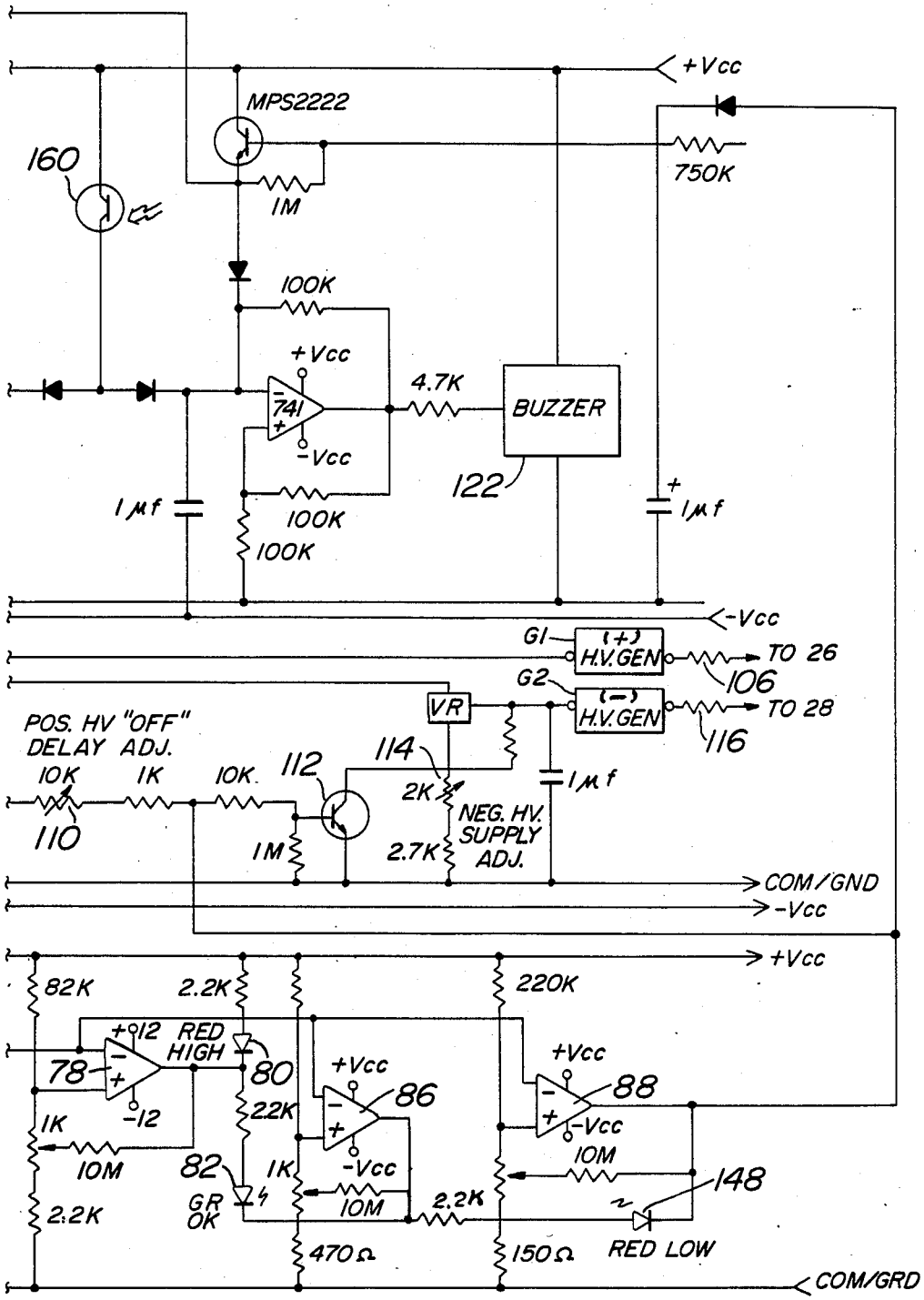

Referring now to FIG. 4A and 4B, there is shown the electrical circuitry for controlling the operation of the high voltage generators G1 and G2, including means for sensing and indicating the various electrical and gas flow conditions. A pressure differential sensor 70 in the filter monitoring circuit is coupled to a flow meter 58 interposed between the gas tubing 56 and the valve of the compressed gas tank (not shown). The sensor 70 monitors gas flow by measuring the pressure differential with respect to both sides of orifice 68 in flow meter 58 through ports 150 and 152. Adjustment of rheostat 72 provides a balanced adjustment for the differential amplifier circuit composed of operational amplifier 74. The signal developed in the output of operational amplifier 76 is applied to the inverting inputs of voltage comparators 78, 86 and 88. Non-inverting inputs have predetermined voltages applied to them, so that when the gas flow is within nominal range, the output of comparator 78 is "high" (i.e. close to $+V_{cc}$) while the outputs of comparators 86 and 88 are "low" (i.e. close to common), and Green LED 82 is "ON" to indicate the normal condition of the filter. When gas flow is higher than the nominal range due to either a ruptured condition of filter 60 (or a lack of such filter), the output of comparator 78 goes "low" whereby Green LED 82 turns "OFF" and Red LED 80 comes "ON" warning about a filter problem. When gas flow is below nominal range, for example when the filter 60 is clogged, Red LED 148 comes "ON" as a result of the output of comparator 86 going "high". The output of comparator 88 stays "low" so long as gas flow continues through the gun. This voltage level turns transistors 90 and 112 off thereby energizing each of the high voltage power supplies G1 and G2.

The high voltage switching and delay circuitry together with the controls for the respective high voltage generators G1 and G2 are set forth in FIG. 4A and 4B. Variable resistor 102 is utilized to adjust the output of the positive high voltage supply G1 whereas variable resistor 114 is used to adjust the output of the negative high voltage source G2.

Thus, ion flow is balanced by adjusting the levels of the respective positive and negative voltages applied to the electrodes B so that during operation of the gun, no net charge is transferred to the objects being targeted. However, when the gas flow is first triggered and ionization initiated, it has been found that an excess of positive ions is present during the moment of inception of gas flow, thereby charging the object positively during the start of treatment. Immediately thereafter, the ion flow regains its balanced state and the potential of the object is reduced to neutralized condition (zero potential) to remain at that neutral level until the trigger D is released for turn-off of static elimination treatment. At this stage, when simultaneous high voltage cut off to both generators G1 and G2 is concurrent with discontinuation of gas flow, it has been found in a similar manner that an preponderance of negative ions is contained in the last spurt of gas to produce a negative charging of the articles at treatment termination. In order to correct this undesirable effect of charging at the end of treatment, the delay circuitry of the present invention is built into the controls of the power supply switching.

Referring back to FIG. 4A and 4B, the said delay network comprises a pair of transistors 90 and 112, including a capacitor 154 and two variable resistors 104 and 110 coupled therebetween. When gas starts to flow, the output of comparator 88 goes "low", and the comparator's output voltage provides reverse bias to the emitter-base junctions of transistors 90 and 112. Both transistors 90 and 112 are then in the cut off state, and the voltage outputs from voltage regulators 92 and 93 are applied to the respective high voltage generators G1 and G2, the high voltage outputs of which are connected to the corresponding ion discharge electrodes 26 and 28. Delay of the application of voltage to the positive ion discharge electrode 26 is achieved by charging the capacitor 154 through variable resistor 110. When the trigger D is released to cut off gas flow, output of comparator 88 goes "high" whereby forward bias is provided with respect to the emitter-base junctions of transistors 90 and 112. Both transistors 90 and 112 start conducting, causing the output of voltage regulators 92 and 93 to drop thus effecting deactivation of the high voltage generators G1 and G2. The delay in cutting off high voltage to the positive ion discharge electrode 26 (and hence sustaining positive ion production for a predetermined time after discontinuance of gas flow) is achieved by discharging capacitor 154 through variable resistor 104 and the base-emitter junction of transistor 90. The, values of the variable resistors 104 and 110 are selected to provide a wide range of adjustment to compensate for variances in high voltage parameters.

FIG. 4A and 4B also illustrates circuitry for indicating when the high voltage outputs are either out-of-balance or when these voltage outputs have fallen below a predetermined level. These conditions are determined by monitoring the outputs of the high voltage generators G1 and G2. High voltage resistors 144 and 146 coupled to the outputs of the generators G1 and G2 constitute respective voltage dividers in combination with resistor 142. When the ion current produced by the positive and negative electrodes 26 and 28 are approximately equal (i.e. ion flow is balanced) the currents flowing in each direction through resistor 142 offset each other so that the voltage drop across this resistor is very low. This voltage is applied to comparators 138 and 140, the outputs of which in this case will cause LED 136 to light up, signifying balanced ion output. If the balance of currents changes, that LED 136 will switch off. In addition, LED 158 coupled with phototransistor 160 will also switch off causing Red LED 120 to switch "ON" and buzzer 122 will sound an audible alarm warning the operator of unbalanced ion flow. If for some reason, the outputs of both high voltage generators G1 and G2 both drop but ion output remains balanced, only LED 120 will switch "ON", alerting the operator that static neutralization is no longer effective.

As is apparent from the foregoing description, the use of the Venturi-ported nozzle in the ionizing gas gun of the present invention allows utilization of compressed nitrogen as well as compressed air without readjustment of the high voltage supplies, thereby compensating for the greater mobility of nitrogen ions and higher ionization capability thereof vis-a-vis air by enabling ambient air to be drawn through the ports into the inter-electrode zone. In order to evaluate the efficiency of the Venturi-ported nozzle, the same test was performed first using the gun without Venturi ports in the nozzle, and then using the gun with Venturi ports in the nozzle.

In that test an isolated-from-ground metal plate, whose electric potential was monitored with a non-contact electrostatic voltmeter, was first charged to +5,000 volts. The gas gun was connected to a source of compressed air and directed toward the charged plate. The trigger D of the gun was squeezed to apply high voltage to the discharge electrodes B and release the ionized air stream toward the charged plate. The decay of the plate potential was recorded. The same measurements were repeated with −5,000 volts applied to the object plate. Next, compressed nitrogen was substituted for compressed air in the gun, and the test was performed again.

The results of the tests are shown in FIG. 5 wherein it is demonstrated that when nitrogen is exchanged for the air as the ionizing medium in a non-ported ionizing nozzle, the decay of the charge on the targeted object plate is much slower in the case of nitrogen than in air.

In FIG. 6, the results of a test demonstration are shown using the Venturi-ported nozzle of the instant invention. The test conditions were maintained exactly the same. Here, the decay curves of the charged object plate are substantially identical with nitrogen as the gas medium as they were for air.

It can also be readily be shown from tests performed using a conventional gas gun directed toward an isolated object plate that when a balanced positive and negative high voltage is applied to the discharge electrodes simultaneously with each other when gas flow is instituted, momentary positive charging of the plate occurs. The ion flow then quickly regains its balance to yield a zero or neutral plate condition. However, when gas flow is halted with simultaneous high voltage cut-off upon release of the trigger D, the last vestige of gas emanating from the nozzle contains a preponderance of negative ions, as evidenced by a slight negative charging of the object plate at treatment termination (i.e. release of trigger).

By delaying cut-off of the D.C. positive high voltage at trigger release, through appropriate adjustment of the D.C. positive "OFF" delay resistor 110 of the instant invention, the positive ion emission may be sustained when gas flow is turned off to yield a neutral condition upon termination of treatment. Similarly, by appropriate adjustment of the D.C. positive "ON" delay resistor 104 the positive ion emission may be retarded upon gun start-up to provide a neutral condition when the trigger D is first depressed to institute cleaning.

Although this invention has been described in considerable detail, such description is intended as being illustrative rather than limiting, since the invention may be variously embodied without departing from the spirit thereof and the scope of the invention is to be determined as claimed.

What is claimed is:

1. Apparatus for neutralization of static charges on articles for improved cleaning thereof, comprising:

(a) a nozzle of electrically insulative material having an internal passageway coupled to a source of gas under pressure, (b) first electrode means in said nozzle for coupling to a high voltage power source of a first polarity, (c) second electrode means in said nozzle for coupling to a high voltage source of a second polarity, (d) valve means for introducing a stream of a gas under pressure through said passageway and between said first and second electrode means, (e) actuating means for tripping said valve means so as to initiate gas flow when neutralizing and cleansing treatment of charged articles is to be instituted and to interrupt gas flow when neutralizing and cleansing treatment thereof is to be terminated, (f) activating means for applying high voltage to said first and second electrode means when gas flow is forcibly directed through the passageway and discontinuing application of high voltage to said first and second electrode means when gas flow is cut-off, and (g) delay means to suspend discontinuance of the application of high voltage to the first electrode means for a predetermined length of time subsequent to discontinuance of high voltage to the second electrode means when the gas is cut off so as to sustain ion emission momentarily from said first electrode means whereby balanced neutralization will be achieved upon termination of treatment.

2. The apparatus of claim 1 wherein said actuating means for tripping said valve means comprises a trigger.

3. The apparatus of claim 1 wherein said first and second electrode means comprise points adjacently spaced from each other in opposed axially aligned disposition within said passageway transverse to the direction of gas flow.

4. The apparatus of claim 1 including at least one peripheral port extending through said nozzle and communicating with the internal passageway adjacent the first and second electrode means whereby ambient air may be drawn into the inter-electrode zone when nitrogen rather than air is employed as the compressed gas source so as to dilute the effect of the greater mobility of nitrogen ions and higher ionization capability thereof with respect to air thus enabling a greater portion of the neutralizing ions generated to become available for impingement upon targeted articles.

5. The apparatus of claim 1 including second delay means to suspend the application of high voltage to said first electrode means for a predetermined length of time after institution of gas flow and application of the high voltage source of the second polarity to said second electrode means so as to retard ion emission of the first polarity whereby balanced ion neutralization will be achieved upon institution of treatment.

6. The apparatus of claim 1 including means constituting a filter interposed across said passageway.

7. The apparatus of claim 6 including sensing means to monitor gas flow through said nozzle, and signal means to detect deviation of gas flow from a predetermined nominal level so as to indicate rupture or clogging of the filter or improper installation thereof.

8. The apparatus of claim 1, including means to monitor the high voltage output of each of said high voltage power supplies, and alarm means to signal when either of the high voltage outputs thereof falls below a predetermined level.

9. Apparatus for neutralization of static charges on articles for improved cleansing thereof, comprising:

(a) a nozzle of electrically insulative material having an exit orifice and an internal passageway therein for coupling to a source of gas under pressure, (b) valve means for releasing the compressed gas through the passageway, (c) first electrode means in said nozzle for connection to a high voltage power source of a first polarity and second electrode means in said nozzle for connection to a high voltage power source of a second polarity, said first and second electrode means being adjacently spaced from each other and disposed in said passageway transverse to the flow of gas therethrough, (d) means for coupling said first and second electrode means to respective positive and negative high voltage power supply sources so that, when the compressed gas source is air, a predetermined level of dual polarity ionization will be produced by and between said electrode means and discharged through the exit orifice, and (e) at least one port in said nozzle peripheral to the exit orifice for drawing air into the gas stream adjacent the electrode means to admix therewith and act as a dilutant therefor when the compressed gas is nitrogen and thereby compensate for the higher mobility of nitrogen ions and greater output current produced thereby with respect to air so that overloading of the high voltage power sources may be avoided thus enabling a greater portion of neutralizing ions generated by the electrode means to be available for impingement upon targeted articles.

10. The apparatus of claim 9 including a trigger for actuating said valve means.

11. The apparatus of claim 10 including sensing means responsive to gas flow through the nozzle for activating the application of high voltage upon said electrode means.

12. The apparatus of claim 11 wherein said first and second electrode means comprise a pair of conductive points axially spaced from each other in opposed disposition and wherein the high voltage power source comprises D.C. generator means for applying high voltage of a positive polarity upon one of said points and high voltage of a negative polarity upon the other of said points.

13. The apparatus of claim 12 including balancing means to adjust the level of the positive and negative high voltages applied to the respective points so that an equal number of ions of each polarity will be emitted thereby.

14. The apparatus of claim 13 including delay means to suspend discontinuance of the D.C. positive high voltage to the first point for a predetermined length of time subsequent to discontinuance of negative high voltage to the other point when the gas is cut off whereby positive ion emission will be sustained sufficiently to provide balanced neutralization of targeted articles when the trigger is released.

15. The apparatus of claim 14 including second delay means to suspend application of the D.C. positive high voltage to the first point for a predetermined length of time after institution of gas flow and application of the negative high voltage to the other point so as to retard positive ion emission sufficiently to provide balanced neutralization of targeted articles when the trigger is actuated.

16. The apparatus of claim 9 including means constituting a filter interposed across said passageway.

17. The apparatus of claim 16 including means to monitor the rate of gas flow through said nozzle, and signal means to detect deviation of gas flow from a predetermined nominal level so as to warn of a ruptured or clogged filter or improper installation thereof.

18. The apparatus of claim 13 including means to monitor the high voltage outputs of the D.C. generator means and alarm means to sound an alarm when either high voltage output falls below a predetermined level.

19. Apparatus for static neutralization of articles and to effect cleaning of charged particles therefrom, comprising:

(a) a nozzle of electrically insulative material having an exit orifice and an internal passageway therein for coupling to a source of gas under pressure, (b) valve means for releasing the compressed gas through the passageway, including a trigger for actuating said valve means, (c) at least one pair of discharge points adjacently spaced from each other in opposed axially aligned disposition transverse to the direction of gas flow, (d) means for coupling the discharge points to respective positive and negative high voltage power sources, including balancing means for adjusting the output of said high voltage power sources so that an equal number of positive and negative ions will be emitted by said discharge points, (e) port means in said nozzle peripheral to the exit orifice for drawing air into the gap between said discharge points to admix with and dilute the effect of ionization of the gas stream when the compressed gas is nitrogen thereby enabling a greater portion of neutralizing ions emitted by said discharge points to be available for impingement upon targeted articles, (f) sensing means responsive to gas flow through the nozzle for activating the application of the positive and negative high voltages upon the respective discharge points, and (g) delay means to suspend discontinuance of the D.C. positive high voltage to the corresponding discharge point for a predetermined length of time after discontinuance of the negative high voltage to the other discharge point when gas flow is cut off whereby positive ion emission will be sustained sufficiently to provide balanced neutralization of targeted articles upon termination of treatment.

20. The apparatus of claim 19 including a filter interposed across the nozzle passageway for removing particulate material from the gas stream, and means to monitor the rate of gas flow through said nozzle and signal deviation from a predetermined level of such gas flow to warn of a ruptured or clogged filter or improper installation thereof.

* * * * *